US010526881B2

(12) United States Patent
Chen et al.

(10) Patent No.: US 10,526,881 B2
(45) Date of Patent: Jan. 7, 2020

(54) SOLVENTS AND NON-CONDENSABLE GAS COINJECTION

(71) Applicant: CONOCOPHILLIPS COMPANY, Houston, TX (US)

(72) Inventors: Bo Chen, Houston, TX (US); Qing Chen, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 324 days.

(21) Appl. No.: 14/955,894

(22) Filed: Dec. 1, 2015

(65) Prior Publication Data

US 2016/0153270 A1 Jun. 2, 2016

Related U.S. Application Data

(60) Provisional application No. 62/086,002, filed on Dec. 1, 2014.

(51) Int. Cl.
*E21B 43/24* (2006.01)

(52) U.S. Cl.
CPC ..... *E21B 43/2408* (2013.01)

(58) Field of Classification Search
CPC .. E21B 43/24; E21B 43/2406; E21B 43/2408; E21B 43/305; E21B 43/164; E21B 43/166
See application file for complete search history.

(56) References Cited

U.S. PATENT DOCUMENTS

| | | | | |
|---|---|---|---|---|
| 4,008,764 | A * | 2/1977 | Allen | C09K 8/58 166/266 |
| 4,344,485 | A * | 8/1982 | Butler | E21B 43/2405 166/265 |
| 5,273,111 | A | 12/1993 | Brannan | |
| 5,803,171 | A | 9/1998 | McCaffery | |
| 6,257,334 | B1 | 7/2001 | Cyr | |
| 7,556,099 | B2 | 7/2009 | Arthur | |
| 8,327,936 | B2 | 12/2012 | Coskuner | |
| 8,689,865 | B2 | 4/2014 | Banerjee | |
| 2005/0211434 | A1* | 9/2005 | Gates | C09K 8/592 166/272.3 |
| 2007/0295499 | A1* | 12/2007 | Arthur | E21B 43/2406 166/245 |
| 2008/0017372 | A1* | 1/2008 | Gates | E21B 43/16 166/254.1 |
| 2009/0255661 | A1* | 10/2009 | Clark | E21B 41/0035 166/50 |
| 2012/0247760 | A1* | 10/2012 | Wheeler | E21B 43/2406 166/272.3 |

(Continued)

OTHER PUBLICATIONS

Schlumberger Oilfield Glossary—Cyclic Steam Injection—Accessed (2019) https://www.glossary.oilfield.slb.com/en/Terms/c/cyclic_steam_injection.aspx (Year: 2019)*

*Primary Examiner* — David Carroll
(74) *Attorney, Agent, or Firm* — Boulware & Valoir

(57) ABSTRACT

Producing hydrocarbons by steam assisted gravity drainage, more particularly, utilizing conventional horizontal wellpair configuration of SAGD in conjunction of infill production well, to coinject oil-based solvents with steam initially and then switch to NCG-steam coinjection after establishing thermal communication between the thermal chamber and infill well.

8 Claims, 3 Drawing Sheets

Monthly oil production

(56) References Cited

U.S. PATENT DOCUMENTS

| | | | |
|---|---|---|---|
| 2012/0292055 | A1 | 11/2012 | Swist |
| 2014/0034296 | A1 | 2/2014 | Chen et al. |
| 2014/0124194 | A1 | 5/2014 | Jorshari |
| 2015/0114637 | A1 | 4/2015 | Lo |

* cited by examiner

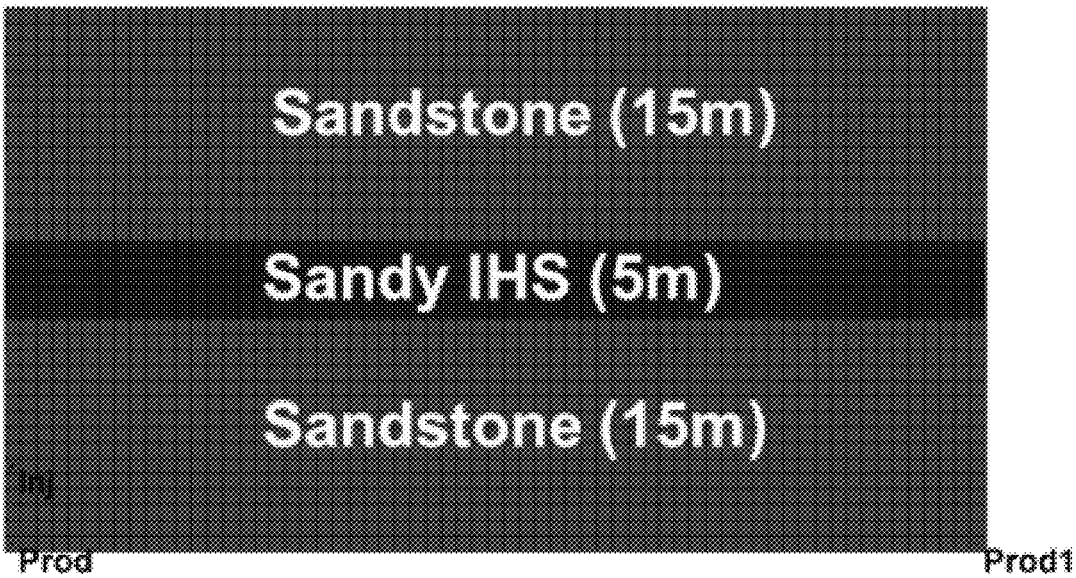
Figure 1: 2D layered simulation Model
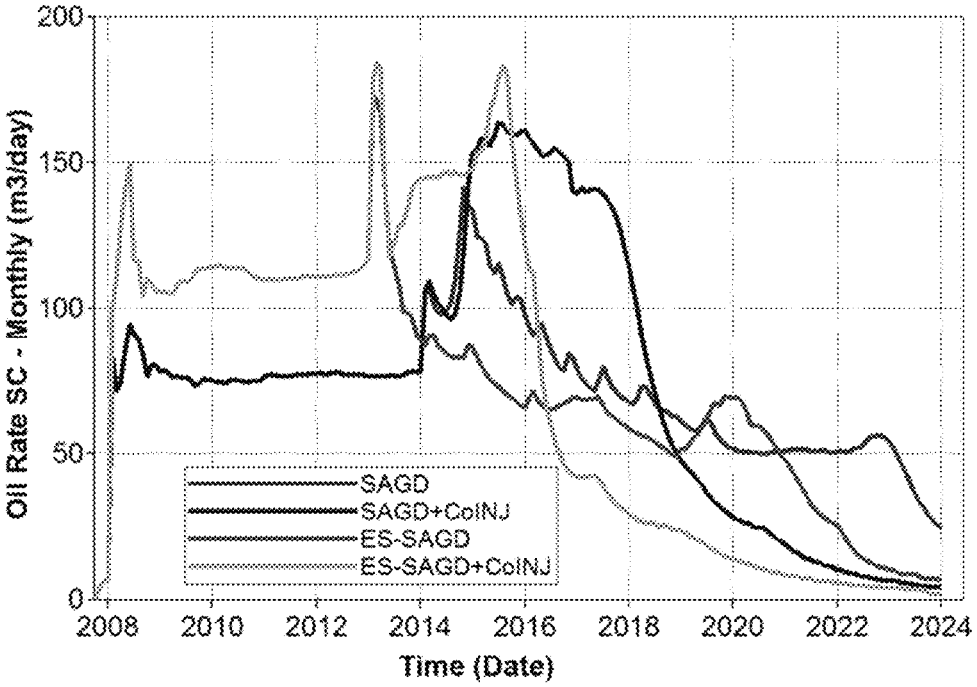
Figure 2: Monthly oil production

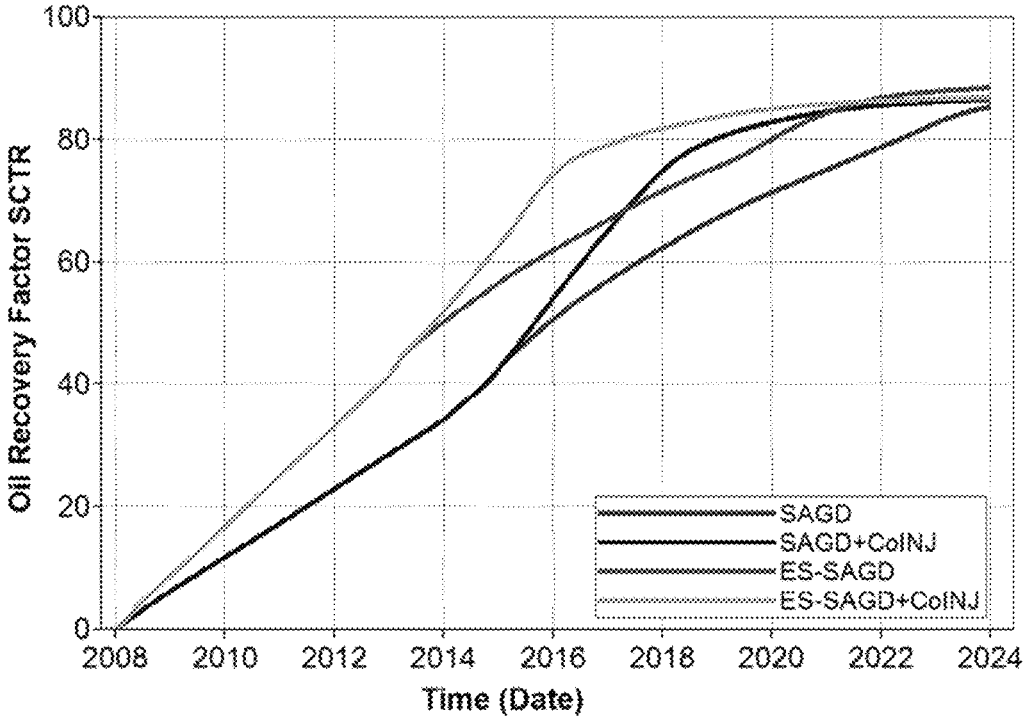
Figure 3: Oil recovery factor
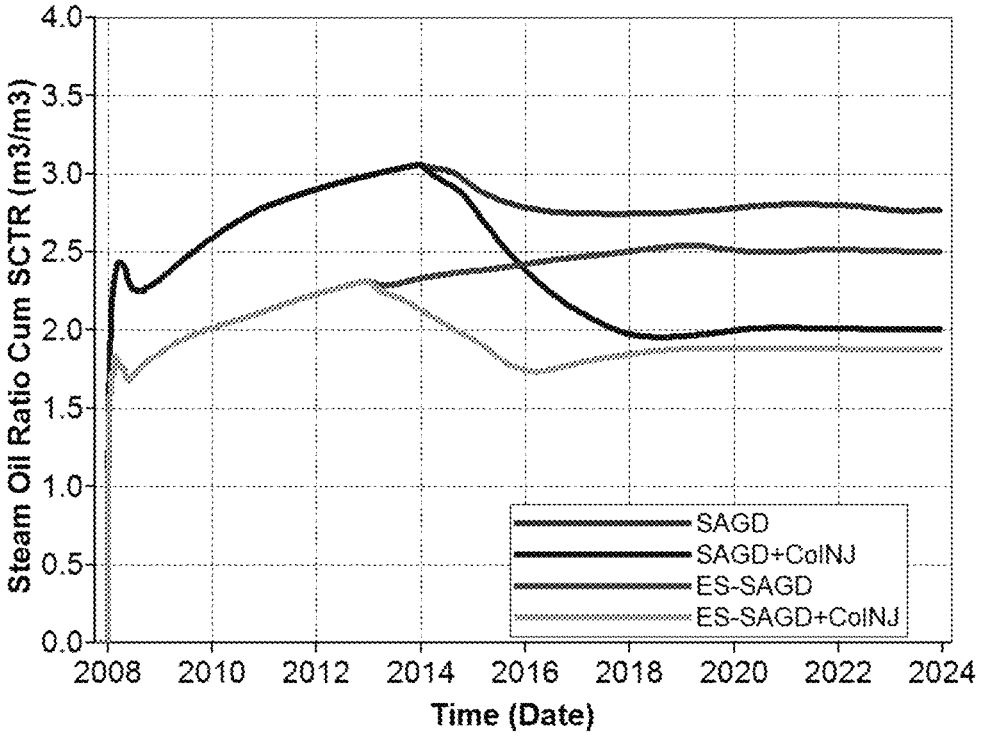
Figure 4: Cumulative steam-oil ratio

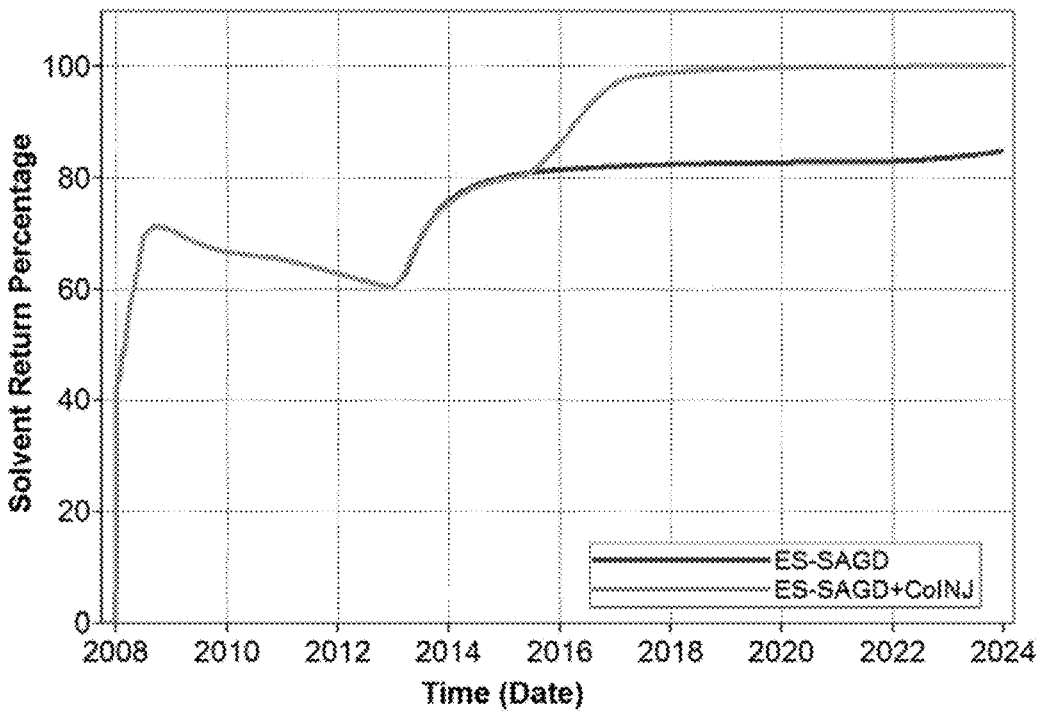
Figure 5: Solvent return

SOLVENTS AND NON-CONDENSABLE GAS COINJECTION

CROSS-REFERENCE TO RELATED APPLICATIONS

This application is a non-provisional application which claims benefit under 35 USC § 119(e) to U.S. Provisional Application Ser. No. 62/086,002 filed Dec. 1, 2014, entitled "Solvents and Non-Condensable Gas Coinjection," which is incorporated herein in its entirety.

STATEMENT REGARDING FEDERALLY SPONSORED RESEARCH

None.

FIELD OF THE INVENTION

The present invention relates generally to producing hydrocarbons by steam assisted gravity drainage. More particularly, but not by way of limitation, embodiments of the present invention include utilizing conventional horizontal wellpair configuration of SAGD in conjunction of infill production well, to coinject oil-based solvents with steam initially and then switch to NCG-steam coinjection after establishing thermal communication between the thermal chamber and infill well.

BACKGROUND OF THE INVENTION

Bitumen recovery from oil sands presents technical and economic challenges due to high viscosity of the bitumen at reservoir conditions. Steam assisted gravity drainage (SAGD) provides one process for producing the bitumen from a reservoir. During SAGD operations, steam introduced into the reservoir through a horizontal injector well transfers heat upon condensation and develops a steam chamber in the reservoir. The bitumen with reduced viscosity due to this heating drains together with steam condensate along a boundary of the steam chamber and is recovered via a producer well placed parallel and beneath the injector well.

However, costs associated with energy requirements for the SAGD operations limit economic returns. Accumulation in the reservoir of gaseous carbon dioxide (CO2) and/or solvent that may be injected with the steam in some applications can further present problems. For example, the gaseous CO2/solvent acts as a thermal insulator impairing heat transfer from the steam to the bitumen, decreases temperature of the drainage interface due to partial pressure impact, and decreases effective permeability to oil as a result of increased gas saturation.

Therefore, a need exists for methods and systems for recovering hydrocarbons from oil sands with an efficient steam-to-oil ratio.

BRIEF SUMMARY OF THE DISCLOSURE

This invention proposes a new in-situ oil sands/heavy oil recovery process that combines solvent-steam and non-condensable gas (NCG)-steam coinjections to accelerate oil recovery, while improving energy efficiency for reservoirs of specific geologic settings. The specific geologic settings refer to reservoirs that have good quality pay, such as clean sand, overlaid by relatively poor quality pay, such as inclined heterolithic stratification (IHS) layers, which are very common in Athabasca oil sands. In those reservoirs, conventional SAGD normally yields a high steam-oil ratio (SOR) due to the inefficient oil drainage from IHS layers by steam. NCG-steam coinjection with use of infill wells can effectively enhance oil drainage from IHS layers and reduce SOR; however, it cannot start early. The proposed process utilizes the conventional horizontal wellpair configuration of SAGD in conjunction of infill production well, to coinject oil-based solvents with steam from beginning and then switch to NCG-steam coinjection after establishing thermal communication between the thermal chamber and infill well. This new process enjoys the same advantages of both solvent-steam coinjection, i.e., ES-SAGD, and NCG-steam coinjection in terms of oil recovery acceleration and SOR reduction, but with greater magnitude. The simulation shows that the well life for 80% oil recovery is 9 years for the proposed process as compared to 11 years, 12 years, and 14 years for cases of SAGD+NCG, ES-SAGD and SAGD, respectively. The predicted CSOR at 80% oil recovery is 1.85 m3/m3 for the new process, which is 7.5%-34% lower than that of the other three processes. In addition, the new process helps reduce solvent retention that is often considered as one of the biggest risks of ES-SAGD commercialization. Our simulation results show nearly 20% solvent retention rate in ES-SAGD while visually 0% solvent retention rate in the new process. In the proposed process, the coinjected oil-based solvents can be C3-C10 with a variant composition in the injection stream of 0.1-50 mol %. The coinjected NCG can be methane, nitrogen, air, carbon dioxide, flue gas, or a mixture of these gases with a variant composition in the injection stream of 0.1-100 mol %.

A process for producing hydrocarbons is described where:

- a reservoir has a good quality pay overlaid by relatively poorer quality pay;
- a horizontal wellpair includes an injection well and a production well;
- one or more infill production wells;
- initially co-injecting oil-based solvents and steam through said injection well;
- establishing thermal communication between the thermal chamber and one or more infill production wells;
- switching to co-injecting NCG and steam injection; and
- producing hydrocarbons.

Hydrocarbons produced by this process include heavy oil, bitumen, tar sands, extra heavy oil, and the like.

The oil-based solvents may be $C_3$-$C_{30}$ alkanes, alkenes, dienes, alkynes, cycloalkanes, naphthenes, aromatic hydrocarbons, propane, butane, pentane, cyclopentane, hexane, cyclohexane, octane, nonane, hexadecane, benzene, toluene, diesel, gasoline, fuel oil, kerosene, jet fuel, gasoils, naphtha, or combinations thereof.

The NCG may be air, carbon dioxide ($CO_2$), nitrogen ($N_2$), carbon monoxide (CO), hydrogen sulfide ($H_2S$), hydrogen ($H_2$), anhydrous ammonia ($NH_3$), flue gas, or combinations thereof.

As used herein, "bitumen" and "extra heavy oil" are used interchangeably, and refer to crudes having less than 10° API.

As used herein, "heavy oil" refers to crudes having less than 22° API. The term heavy oil thus includes bitumens, unless it is clear from the context otherwise.

By "horizontal production well", what is meant is a well that is roughly horizontal (>45° off a horizontal plane) where it is perforated for collection of mobilized heavy oil. Of course, it will have a vertical portion to reach the surface, but this zone is typically not perforated and does not collect oil.

By "vertical" well, what is meant is a well that is roughly vertical (≤45° off a vertical line).

By "injection well" what is meant is a well that is perforated, so that steam or solvent can be injected into the reservoir via said injection well. An injection well can easily be converted to a production well (and vice versa), by ceasing steam injection and commencing oil collection.

Thus, injection wells can be the same as production wells, or separate wells can be provided for injection purposes. It is common at the start up phase for production wells to also be used for injection, and once fluid communication is established, switched to production uses.

As used herein a "production stream" or "production fluid" or "produced heavy oil" or similar phrase means a crude hydrocarbon that has just been pumped from a reservoir and typically contains mainly heavy oil and/or bitumen and water, and may also contain additives such as solvents, foaming agents, and the like.

By "mobilized" oil, what is meant is that the oil viscosity has been reduced enough for the mobilized oil to be produced.

By "steam", we mean a hot water vapor, at least as provided to an injection well, although some steam will of course condense as the steam exits the injection well and encounters cooler rock, sand or oil. It will be understood by those skilled in the art that steam usually contains additional trace elements, gases other than water vapor, and/or other impurities. The temperature of steam can be in the range of about 150° C. to about 350° C. However, as will be appreciated by those skilled in the art, the temperature of the steam is dependent on the operating pressure, which may range from about 100 psi to about 2,000 psi (about 690 kPa to about 13.8 MPa).

In the case of either the single or multiple wellbore embodiments of the invention, if fluid communication is not already established, it must be established at some point in time between the producing wellbore and a region of the subterranean formation containing the hydrocarbon fluids affected by the injected fluid, such that heavy oils can be collected from the producing wells.

By "fluid communication" we mean that the mobility of either an injection fluid or hydrocarbon fluids in the subterranean formation, having some effective permeability, is sufficiently high so that such fluids can be produced at the producing wellbore under some predetermined operating pressure. Means for establishing fluid communication between injection and production wells includes any known in the art, including steam circulation, geomechanically altering the reservoir, RF or electrical heating, ISC, solvent injection, hybrid combination processes and the like.

By "start up" what is meant is that period of time when most or all wells are being used for steam injection in order to establish fluid communication between the wells. Start-up typically requires 3-6 months in traditional SAGD.

By "providing" wellbores herein, we do not imply contemporaneous drilling. Therefore, either new wells can be drilled or existing wells can be used as is, or retrofitted as needed for the method.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention.

The following abbreviations are used herein:

| ABBREVIATION | TERM |
|---|---|
| API | American Petroleum Institute |
| API gravity | To derive the API gravity from the density, the density is first measured using either the hydrometer, detailed in ASTM D1298 or with the oscillating U-tube method detailed in ASTM D4052. Direct measurement is detailed in ASTM D287. |
| bbl | barrel |
| Cp | Centipoise |
| CSOR | Cumulative steam/oil ratio |
| CSS | Cyclic Steam Stimulation |
| cSt | Centistokes. Kinematic viscosity is expressed in centistokes |
| DSG | Direct Steam Generation |
| EOR | Enhanced oil recovery |
| ES-SAGD | Expanding solvent-SAGD |
| NCG | Non-condensable gas |
| OOIP | Original oil In place |
| OTSG | Once-through steam generator |
| SAGD | Steam assisted gravity drainage |
| SAGP | Steam and gas push |
| SAP | Solvent assisted process or Solvent aided process |
| SCTR | Sector recovery |
| SF | Steam flooding |
| SF-SAGD | Steam flood SAGD |
| SOR | Steam-to-oil ratio |
| THAI | Toe to heal air injection |
| VAPEX | Vapor extraction |
| XSAGD | Cross SAGD where producers and injectors are perpendicular and used in an array. |

BRIEF DESCRIPTION OF THE DRAWINGS

A more complete understanding of the present invention and benefits thereof may be acquired by referring to the follow description taken in conjunction with the accompanying drawings in which:

FIG. 1 depicts 2D layered simulation model,

FIG. 2 illustrates monthly oil production over time,

FIG. 3 illustrates oil recovery factor over time,

FIG. 4 illustrates cumulative steam-oil ratio over time, and

FIG. 5 illustrates solvent return over time

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Previously, Chen, et al. (US 2014-0034296) produce hydrocarbons by steam assisted gravity drainage with dual producers separated vertically and laterally from at least one injector. Lo and Chen (U.S. Ser. No. 14/524,205) improve hydrocarbon recovery utilizing alternating steam and steam-plus-additive injections.

This invention proposes a new in-situ oil sands/heavy oil recovery process that combines solvent-steam and non-condensable gas (NCG)-steam coinjections to accelerate oil recovery, while improving energy efficiency for reservoirs of specific geologic settings. The specific geologic settings refer to reservoirs that have good quality pay, such as clean sand, overlaid by relatively poor quality pay, such as inclined heterolithic stratification (IHS) layers, which are very common in Athabasca oil sands. In those reservoirs, conventional SAGD normally yields a high steam-oil ratio (SOR) due to the inefficient oil drainage from IHS layers by steam. NCG-steam coinjection with use of infill wells can effectively enhance oil drainage from IHS layers and reduce SOR; however, it cannot start early. The proposed process utilizes the conventional horizontal wellpair configuration of SAGD in conjunction with one or more infill production wells, to coinject oil-based solvents with steam initially switching to NCG-steam coinjection after establishing thermal communication between the thermal chamber and one or more infill wells. This new process enjoys the same advantages of both solvent-steam coinjection, i.e., ES-SAGD, and NCG-steam coinjection in terms of oil recovery acceleration and SOR reduction, but with greater magnitude.

As used herein, hydrocarbon solvent refers to a chemical consisting of carbon and hydrogen atoms which dissolves into products being recovered to increase fluidity and/or decrease viscosity of the products. The hydrocarbon solvent can have, for example, 1 to 12 carbon atoms ($C_1$-$C_{12}$) or 1 to 4 carbon atoms ($C_1$-$C_4$) per molecule. The $C_1$ to $C_4$ hydrocarbon solvent may include methane, ethane, propane and/or butane. The hydrocarbon solvent can be introduced into the formation as a gas or as a liquid. Under the pressures of the formation, the hydrocarbon solvent may be another example of the NCG or may condense from a gas to a liquid, especially if the hydrocarbon solvent has 2 or more carbon atoms.

The NCG refers to a chemical that remains in the gaseous phase under process conditions within the formation. Examples of the NCG include, but are not limited to, air, carbon dioxide ($CO_2$), nitrogen ($N_2$), carbon monoxide (CO), hydrogen sulfide ($H_2S$), hydrogen ($H_2$), anhydrous ammonia ($NH_3$) and flue gas. Flue gas or combustion gas refers to an exhaust gas from a combustion process that may otherwise exit to the atmosphere via a pipe or channel. Flue gas often comprises nitrogen, $CO_2$, water vapor, oxygen, CO, nitrogen oxides ($NO_x$) and sulfur oxides ($SO_x$). The NCG can make up from 1 to 40 volume percent of a mixture that is injected into the formation.

The following examples of certain embodiments of the invention are given. Each example is provided by way of explanation of the invention, one of many embodiments of the invention, and the following examples should not be read to limit, or define, the scope of the invention.

Example 1: Simulated Oil Recovery

Simulation shows that the well life for 80% oil recovery is 9 years for the proposed process as compared to 11 years, 12 years, and 14 years for cases of SAGD+NCG, ES-SAGD and SAGD, respectively. The predicted CSOR at 80% oil recovery is 1.85 $m^3/m^3$ for the new process, which is 7.5%-34% lower than that of the other three processes. In addition, the new process helps reduce solvent retention that is often considered as one of the biggest risks of ES-SAGD commercialization. Our simulation results show nearly 20% solvent retention rate in ES-SAGD while visually 0% solvent retention rate in the new process. In the proposed process, the coinjected oil-based solvents can be C3-C10 with a variant composition in the injection stream of 0.1-50 mol %. The coinjected NCG can be methane, nitrogen, air, carbon dioxide, flue gas, or a mixture of these gases with a variant composition in the injection stream of 0.1-100 mol %.

In closing, it should be noted that the discussion of any reference is not an admission that it is prior art to the present invention, especially any reference that may have a publication date after the priority date of this application. At the same time, each and every claim below is hereby incorporated into this detailed description or specification as a additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

REFERENCES

All of the references cited herein are expressly incorporated by reference. The discussion of any reference is not an admission that it is prior art to the present invention, especially any reference that may have a publication data after the priority date of this application. Incorporated references are listed again here for convenience:

1. US 2014-0034296, Chen, et al., "Well Configurations for Limited Reflux" (2014).
2. U.S. Ser. No. 14/524,205, Lo & Chen, "Alternating SAGD Injections," (2014)

The invention claimed is:

1. A process for producing hydrocarbons, comprising:

a) providing first and second steam assisted gravity drainage (SAGD) well-pairs in a hydrocarbon reservoir having inclined heterolithic stratification layers, each well-pair comprising a horizontal injection well over a horizontal production well;

b) providing a horizontal infill production well in between said first and second SAGD well-pairs;

c) injecting a C3-C30 oil-based solvent-plus-steam through said injection wells in said well-pairs;

d) continuing said injecting step c) until fluid communication between said injection wells in said well-pairs and said infill production well is established;

e) stopping said c3-c30 oil-based solvent-plus-steam injection and switching to injecting a non-condensable gas (NCG)-plus-steam through said injection wells in said well-pairs after said fluid communication between said injection wells in said well-pairs and said infill production well is established, wherein said NCG is selected from the group consisting of air, carbon dioxide (CO2), methane, nitrogen (N2), carbon monoxide (CO), hydrogen sulfide (H2S), hydrogen (H2), anhydrous ammonia (NH3), flue gas, and combinations thereof; and f) producing hydrocarbons from said infill production well and said production wells in said well-pairs in said hydrocarbon reservoir;

wherein a cumulative steam to oil ratio (CSOR) is lower for said process than a CSOR for a process using steam alone, or a process using oil-based solvent-plus-steam alone, or a process using NCG-plus-steam alone.

2. The process of claim 1, wherein said hydrocarbons are selected from the group consisting of heavy oil, bitumen, and tar sands.

3. The process of claim 1, wherein said C3-C30 oil-based solvent is selected from the group consisting of alkanes, alkenes, dienes, alkynes, cycloalkanes, naphthenes, aromatic hydrocarbons, propane, butane, pentane, cyclopentane, hexane, cyclohexane, octane, nonane, hexadecane, benzene, toluene, diesel, gasoline, fuel oil, kerosene, jet fuel, gasoils, naphtha, and combinations thereof.

4. The process of claim 1, wherein said process results in less oil-based solvent retained in said hydrocarbon reservoir than a process using C3-C30 oil-based solvents-plus-steam alone.

5. A process for producing hydrocarbons, comprising:

a) providing first and second steam assisted gravity drainage (SAGD) well-pairs in a hydrocarbon reservoir having inclined heterolithic stratification layers, each well-pair comprising a horizontal injection well over a horizontal production well;

b) providing a horizontal infill production well in between said first and second SAGD well-pairs;

c) injecting a C3-C30 oil-based solvent-plus-steam through said injection wells in said well-pairs;

d) continuing said injecting step c) only until fluid communication between said injection wells in said well-pairs and said infill production well is established;

e) switching to injecting a non-condensable gas (NCG)-plus-steam through said injection wells in said well-pairs after said fluid communication between said injection wells in said well-pairs and said infill production well is established, wherein said NCG is selected from the group consisting of air, carbon dioxide (CO2), methane nitrogen (N2), carbon monoxide (CO), hydrogen sulfide (H2S), hydrogen (H2), anhydrous ammonia (NH3), flue gas, and combinations thereof; and f) producing hydrocarbons from said infill production well and said production wells in said well-pairs in said hydrocarbon reservoir;

wherein said process results in less C3-C30 oil-based solvent retained in said hydrocarbon reservoir than a process using oil-based solvent-plus-steam alone.

6. The process of claim 5, wherein said hydrocarbons are selected from the group consisting of heavy oil, bitumen, and tar sands.

7. The process of claim 5, wherein said C3-C30 oil-based solvent is selected from the group consisting of alkanes, alkenes, dienes, alkynes, cycloalkanes, naphthenes, aromatic hydrocarbons, propane, butane, pentane, cyclopentane, hexane, cyclohexane, octane, nonane, hexadecane, benzene, toluene, diesel, gasoline, fuel oil, kerosene, jet fuel, gasoils, naphtha, and combinations thereof.

8. The process of claim 5, wherein a cumulative steam to oil ratio (CSOR) is lower for said process than a CSOR for a process using steam alone, or a process using oil-based solvent-plus-steam alone, or a process using NCG-plus-steam alone.

* * * * *